US007350592B2

(12) United States Patent
Hahn et al.

(10) Patent No.: US 7,350,592 B2
(45) Date of Patent: Apr. 1, 2008

(54) HAMMER DRILL WITH CAMMING HAMMER DRIVE MECHANISM

(75) Inventors: Norbert Hahn, Hünstetten-Limbach (DE); Ernst Staas, Limburg (DE); Achim Buchholz, Limburg (DE); Michael Stirm, Oberursel (DE); Ralf Bernhart, Idstein (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/351,161

(22) Filed: Feb. 9, 2006

(65) Prior Publication Data

US 2006/0207776 A1 Sep. 21, 2006

(30) Foreign Application Priority Data

Feb. 10, 2005 (GB) ..... 0502705.7

(51) Int. Cl.
*B25D 15/02* (2006.01)
*B25D 11/10* (2006.01)

(52) U.S. Cl. ..... 173/48; 173/205; 173/109; 173/217

(58) Field of Classification Search ..... 173/47, 173/48, 49, 96, 109, 104, 216, 217
See application file for complete search history.

(56) References Cited

U.S. PATENT DOCUMENTS 1,119,866 A 12/1914 Pauli
1,356,556 A 10/1920 Payne
1,452,581 A 4/1923 Welch
1,494,109 A 5/1924 Griner
1,586,103 A 5/1926 Miller
1,708,658 A 4/1929 Brown
1,776,057 A 9/1930 Weibull
1,825,072 A 9/1931 Keller
1,889,441 A 11/1932 Haas
1,925,289 A 9/1933 Strobel
2,293,443 A 8/1942 Mossberg
2,347,364 A 4/1944 Palumbo
2,408,484 A 10/1946 Schwarkopf
2,442,140 A 5/1948 Mohr
2,457,565 A 12/1948 Kott
2,518,429 A 8/1950 Moorhead (Continued)

FOREIGN PATENT DOCUMENTS

DE 28 20 125 A1 11/1979

(Continued)

*Primary Examiner*—Rinaldi I. Rada
*Assistant Examiner*—Lindsay Low
(74) *Attorney, Agent, or Firm*—Michael P. Leary; Charles E. Yocum; Adan Ayala

(57) ABSTRACT

A reciprocating drive mechanism for a striker in a hammer, a rotary hammer, or a power drill having a hammer action, includes a sinusoidal cam channel formed on a drive member and a cam follower, in the form of a ball bearing, attached to a driven member which, due to the interaction of the cam and cam follower, results in a reciprocating movement of the driven member. Both the drive member and driven member can be rotatingly driven by a motor, their relative speeds resulting in the reciprocating movement of the driven member. The driven member is connected to the striker either via a mechanical helical spring or an air spring.

21 Claims, 6 Drawing Sheets

U.S. PATENT DOCUMENTS

| | | | | |
|---|---|---|---|---|
| 2,556,163 | A | | 6/1951 | Beeson et al. |
| 2,940,565 | A | | 6/1960 | Schodeberg |
| 2,968,960 | A | | 1/1961 | Fulop |
| 2,970,483 | A | | 2/1961 | Schrum, Sr. |
| 3,006,202 | A | | 10/1961 | Moorhead |
| 3,018,674 | A | | 1/1962 | Kohler |
| 3,080,008 | A | | 3/1963 | Hendrickson |
| 3,090,450 | A | | 5/1963 | Fulop |
| 3,123,156 | A | | 3/1964 | Gapstur |
| 3,133,601 | A | | 5/1964 | Fulop |
| 3,133,602 | A | | 5/1964 | Fulop |
| 3,145,782 | A | | 8/1964 | De Bruin |
| 3,149,681 | A | | 9/1964 | Drew |
| 3,161,241 | A | * | 12/1964 | Allen et al. ..... 173/14 |
| 3,171,286 | A | | 3/1965 | Stewart |
| 3,260,289 | A | | 7/1966 | Whitten, Jr. |
| 3,268,014 | A | | 8/1966 | Drew |
| 3,270,821 | A | | 9/1966 | Bassett et al. |
| 3,281,157 | A | | 10/1966 | Hendrickson |
| 3,343,246 | A | | 9/1967 | Kelley et al. |
| 3,430,709 | A | | 3/1969 | Miller |
| 3,596,525 | A | | 8/1971 | Niesz |
| 3,685,594 | A | | 8/1972 | Koehler |
| 3,695,365 | A | | 10/1972 | Schadlich |
| 3,837,410 | A | | 9/1974 | Maxwell |
| 3,841,418 | A | | 10/1974 | Biersack |
| 4,073,348 | A | | 2/1978 | Schramm et al. |
| 4,641,714 | A | | 2/1987 | Ferioli |
| 4,892,013 | A | * | 1/1990 | Satoh ..... 475/266 |
| 5,449,044 | A | | 9/1995 | Phillips |
| 5,836,403 | A | | 11/1998 | Putney et al. |
| 5,992,538 | A | | 11/1999 | Marcengill et al. |
| 6,199,640 | B1 | | 3/2001 | Hecht |
| 6,213,222 | B1 | | 4/2001 | Banach |
| 6,457,535 | B1 | * | 10/2002 | Tanaka ..... 173/48 |
| 6,655,473 | B1 | * | 12/2003 | Chi ..... 173/216 |
| 6,698,530 | B2 | | 3/2004 | Hecht |
| 6,988,562 | B2 | | 1/2006 | Hecht |
| 7,032,687 | B2 | | 4/2006 | Rask |

FOREIGN PATENT DOCUMENTS

| | | |
|---|---|---|
| GB | 186142 | 9/1922 |
| GB | 208006 | 12/1923 |
| GB | 249459 | 9/1926 |
| GB | 342356 | 2/1931 |
| GB | 440515 | 1/1936 |
| GB | 612866 | 11/1948 |
| GB | 867627 | 5/1961 |
| GB | 942205 | 11/1963 |
| GB | 1407285 | 9/1975 |
| GB | 1417678 | 12/1975 |
| GB | 1419480 | 12/1975 |
| GB | 2219958 | 12/1989 |

* cited by examiner

HAMMER DRILL WITH CAMMING HAMMER DRIVE MECHANISM

FIELD OF THE INVENTION

The present invention relates to powered hammers, to powered rotary hammers, and to power drills having a hammer action.

BACKGROUND OF THE INVENTION

Rotary hammers are known in which a motor drives a spindle supporting a hammer bit, while at the same time causing a piston tightly fitted within the spindle to execute linear reciprocating motion within the spindle. This motion causes repeated compression of an air cushion between the piston and a ram slidably mounted within the spindle, which causes the ram in turn to execute reciprocating linear motion within the spindle and apply impacts to the hammer bit via a beat piece.

In know designs of rotary hammer, the piston is reciprocatingly driven by the motor via a wobble bearing or crank. However, such designs typical require a large amount of space for such drive systems in relation to the amount of reciprocating movement of the piston.

Further, rotary hammers of this type suffer from the drawback that in order to generate an air cushion between the piston and the ram, the external dimensions of the piston and ram must be closely matched to the internal dimensions of the spindle, which increases the cost and complexity of manufacture of the hammer.

The present invention seeks to overcome or at least mitigate some or all of the above disadvantage of the prior art whilst producing a compact design.

US6199640 is a relevant piece of prior art known to the applicant.

BRIEF SUMMARY OF THE INVENTION

Accordingly, there is provided a power tool comprising:

a housing;

a motor mounted within the housing;

a tool holder rotatably mounted on the housing for holding a cutting tool;

a striker mounted in a freely slideable manner within the housing, for repetitively striking an end of a cutting tool when a cutting tool is held by the tool holder, which striker is reciprocatingly driven by the motor, when the motor is activated, via a drive mechanism;

characterised in that the drive mechanism comprises two parts, a first part comprising a drive member which is capable of being rotatingly driven by the motor;

a second part comprising a driven member which is connected to the drive member by at least one cam and cam follower, and to the striker via a spring;

one part comprising the cam;

the other part comprising the cam follower which is engagement with the cam;

wherein rotation of the drive member relative to the driven member results in a reciprocating motion of the driven member which in turn reciprocatingly drives the striker via the spring.

BRIEF DESCRIPTION OF THE DRAWINGS

Three embodiments of the invention will now be described, by way of example only and not in any limitative sense, with reference to the accompanying drawings, in which.

DETAILED DESCRIPTION OF THE INVENTION

The first embodiment of the present invention will now be described with reference to FIGS. 1 to 3.

Figure 1:
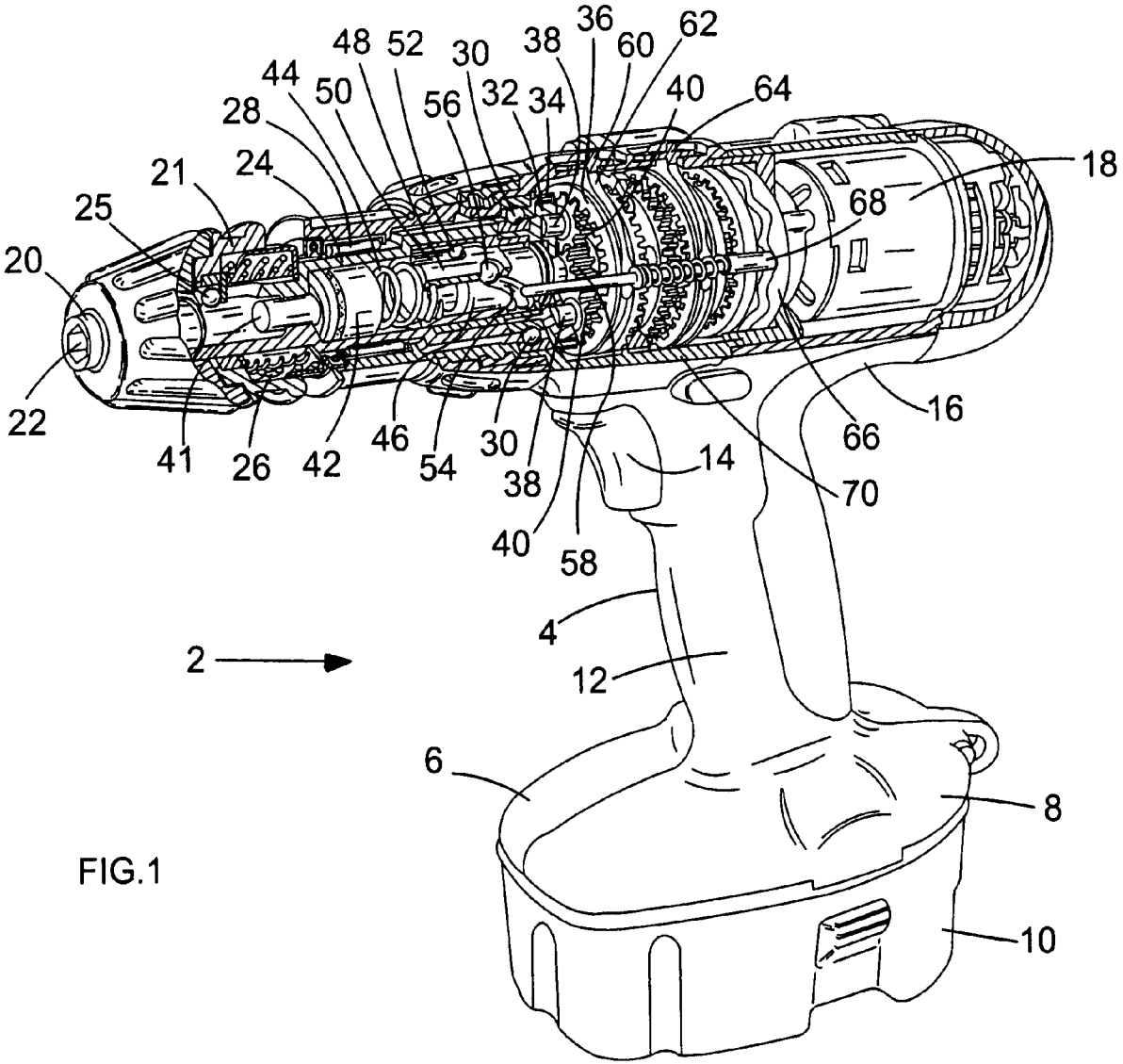
FIG. 1 is a perspective partially cut away view of a rotary hammer of a first embodiment of the present invention.
Figure 2:
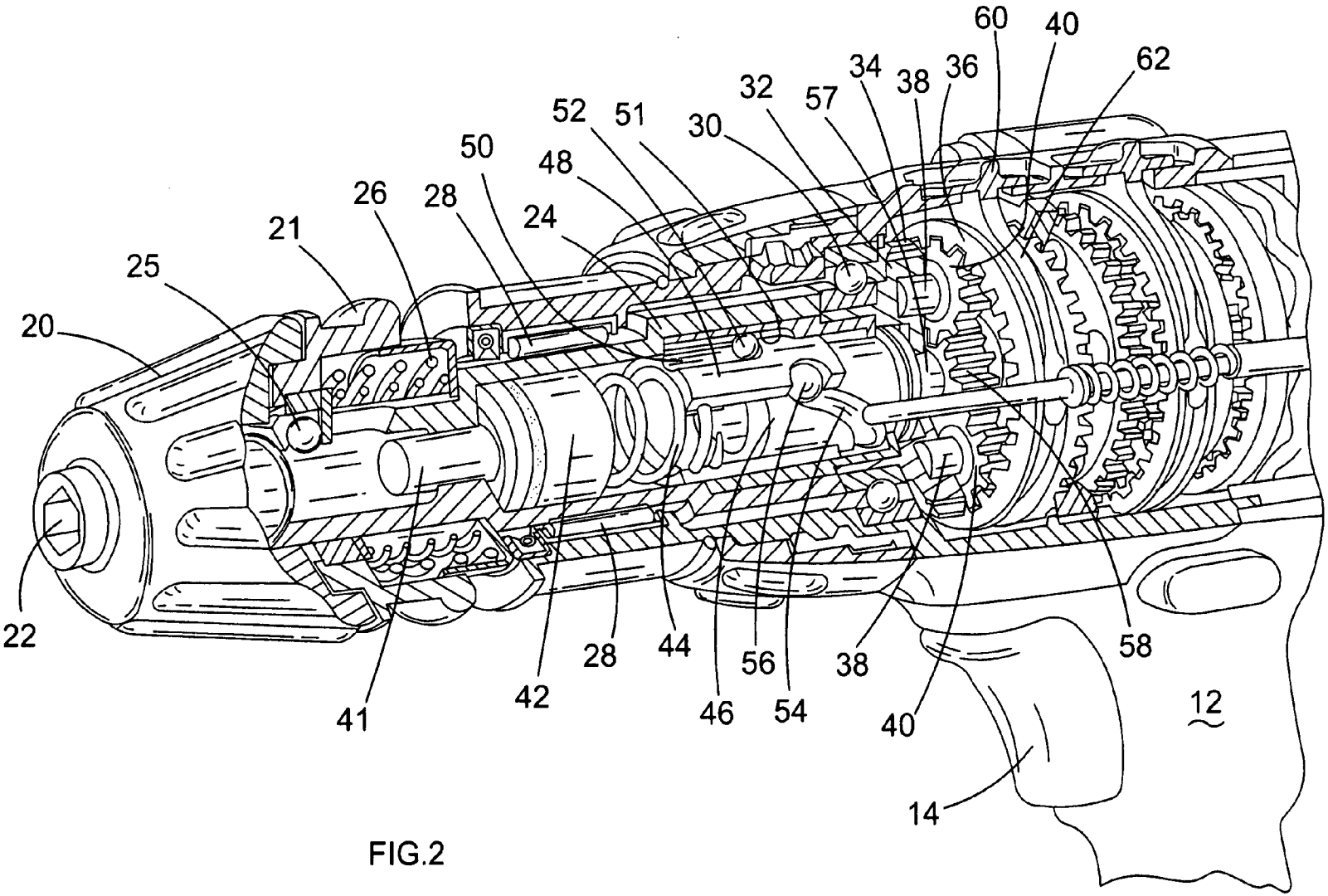
FIG. 2 is a perspective partially cut away close up view of the hammer mechanism of the rotary hammer of FIG. 1.

Referring to FIGS. 1 and 2, a rotary hammer 2 has a housing 4 formed from a pair of mating clam shells 6, 8 of durable plastics material and a removable rechargeable battery 10 removably mounted to a lower part of the housing 4 below a handle 12. The housing 4 defines the handle 12, having a trigger switch 14, and an upper part 16 containing an electric motor 18 actuated by means of trigger switch 14, at a rear part thereof. The electric motor 18 has a rotor which rotates in well known manner when the motor 18 is activated. A chuck 20 is provided at a forward part of the upper part 16 of housing 4 and has an aperture 22 for receiving a drill bit (not shown). The chuck 20 has a gripping ring 21 axially slidably mounted to a hollow spindle 24 for enabling the drill bit to be disengaged from the chuck 20 by rearward displacement of gripping ring 21 relative to the spindle 24 against the action of compression spring 26, to allow ball bearings 25 (of which only one is shown in FIGS. 1 and 2) to move radially outwards to release a shank of the drill bit in well known manner.

The spindle 24 is rotatably mounted in the upper part 16 of the housing 4 by means of forward rollers 28 and rear bearings 30, and is provided at a rear end thereof with an integral end cap 32 of generally circular cross section. The integral end cap 32 comprises teeth 34 located on an outer periphery thereof for engaging an annular gear 36 and three equiangularly spaced apertures for receiving shafts 38 of planet gears 40.

A ram 42 is slidably mounted within hollow spindle 24 and is connected via a mechanical spring 44 to a support cylinder 48. Mounted co-axially within the support cylinder 48 is a cam cylinder 46. The support cylinder 48 is capable of axially sliding within the spindle 24 over a limited range of movement. The support cylinder 48 is provided with at least one axial groove 50 containing a ball bearing 52 for preventing rotation of the support cylinder 48 relative to the hollow spindle 24. The ball bearing 52 achieves this by also being located within an axial groove 51 formed in the inner wall of the spindle 24. The ball bearing is allowed to travel along the length of the two axial grooves 50, 51 but is prevented from exiting them. The axial grooves 50, 51 allow the support cylinder 48 to freely slide in the spindle 24. The cam cylinder 46 is provided with a sinusoidal cam groove 54 receiving ball bearing 56 located in an aperture in support cylinder 48 such that rotation of cam cylinder 46 relative to support cylinder 48 causes oscillatory axial movement of support cylinder 48 in the hollow spindle 24 in such a manner that one complete rotation of cam cylinder 46 relative to the support cylinder 48 causes one complete axial oscillation of support cylinder 48 relative to cam cylinder 46.

The cam cylinder 46 is driven by means of a shaft 57 to which it is attached at its rear end and which is co-axial with the cam cylinder. On the shaft 57 is mounted a central sun gear 58 meshing with planet gears 40. Rigidly attached, in a co-axial manner, to the end of the shaft is a second cap 59 by which the shaft 57 is rotatingly driven. Teeth 63 are formed around the periphery of the second end cap 59. The mechanism by which the second cap 59 and hence the shaft 57 is rotatingly driven is described below. However, activation of the motor 18 always results in rotation of the shaft 57.

Figure 3A:
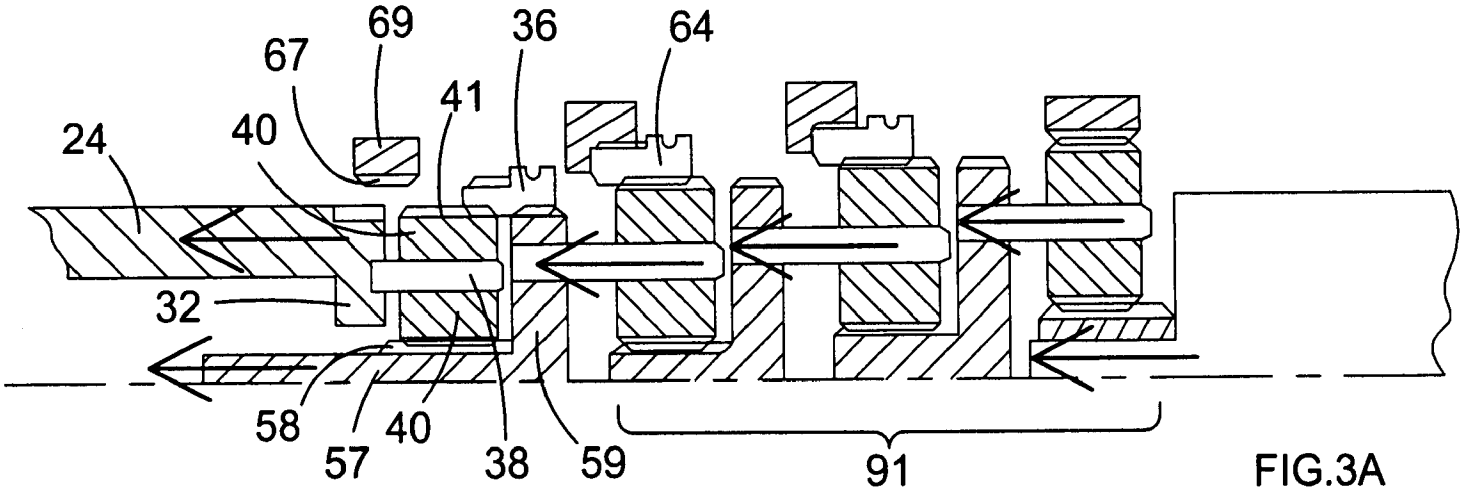
FIGS. 3A to 3D are schematic diagrams of cross sectional side views of the gear mechanism of the rotary hammer of FIG. 1.
Figure 3B:
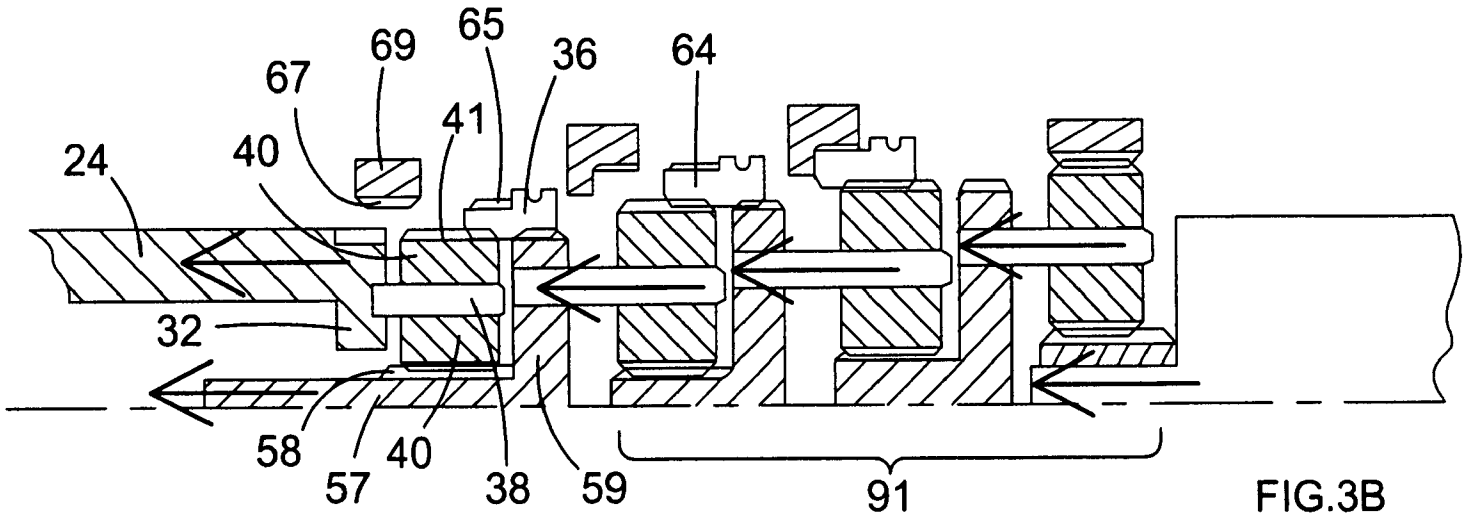
Figure 3C:
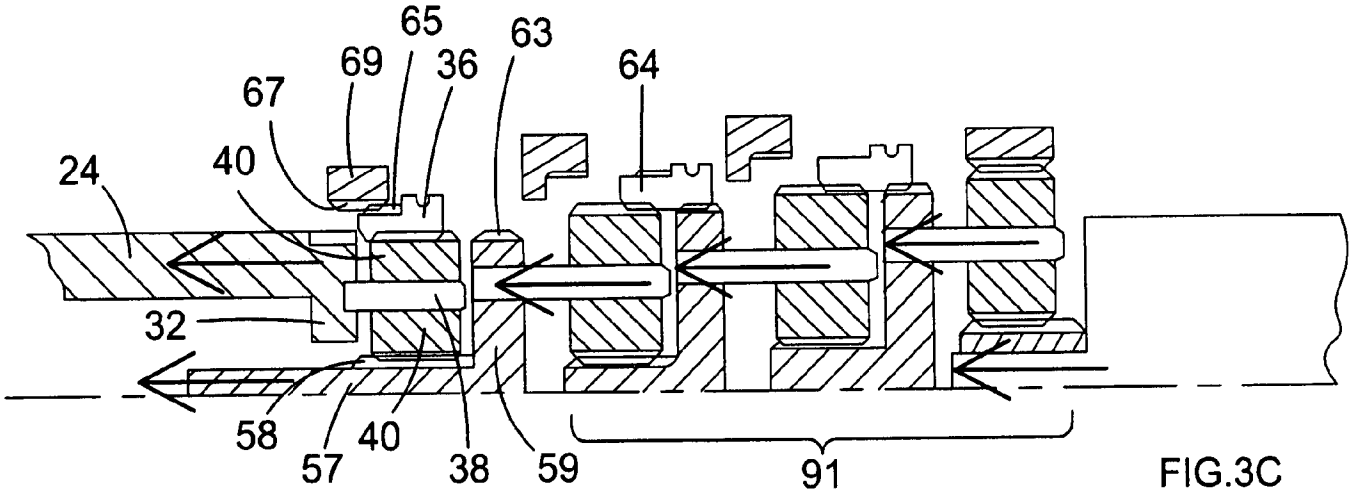
Figure 3D:
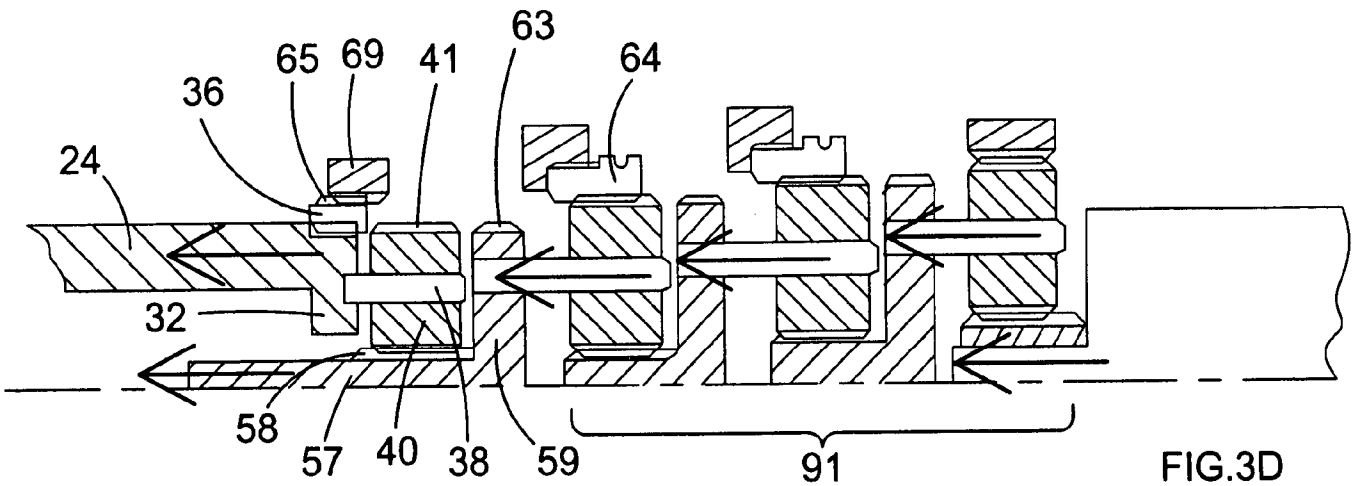

A mode change knob 60 provided on the exterior of the housing 4 is slidable forwards and backwards relative to the housing 4 to cause a lever 62 to move the annular gear 36 between a drill mode (as shown in FIGS. 3A and 3B), a hammer drill mode (as shown in FIG. 3C) and a chisel mode (as shown in FIG. 3D).

In the drill mode, the annular gear 36 is moved rearwardly as shown in FIGS. 3A and 3B to the position shown. FIGS. 3A and 3B both show the gears in the drill mode but with the amount of gear reduction between the motor 18 and the shaft 57 set to two different values.

When the annular gear in this position, it is capable of freely rotating within the housing16. The inwardly facing teeth of the annular gear 36 mesh with both of the teeth 41 of the planet gears 40 and the teeth 63 around the periphery of the second end cap 59. Thus, rotation of the second end cap 59, and hence shaft 57 and central sun gear 58, results in the rotation of the annular gear 36 at the same rate as the second end cap 59. As the planet gears 40 mesh both with the central sun gear 58 and the annular gear 36, and as the annular gear 36 and central sun gear 58 are rotating at the same speed. the planet gears 40 are prevented from rotating about their shafts 38 thus causing the shafts and in turn the integral end cap 32 to rotate at the same speed as the shaft 57 around the axis of the shaft 57. The cam cylinder 46 is connected to the shaft 57 and thus rotates with it. The support cylinder 48 is connect to the integral end cap 32 via the spindle 24 and ball bearing 52 and thus rotates with it. As such, the cam cylinder 46 and the support cylinder 48 rotate at the same rate. As there is no relative movement between the cam cylinder 46 and support cylinder 48, no oscillatory movement is generated as the ball bearing does not travel along the sinusoidal cam groove 54. However, as the spindle 24 is rotating, the chuck 20 also rotates. Thus, when the annular gear 36 is located in the position shown in FIGS. 3A and 3B, the rotary hammer drills only.

In the hammer drill mode, the annular gear 36 is moved to a middle position as shown in FIGS. 3C.

When the annular gear in this position, it is prevented from rotation. The annular gear 36 has a second set of outer teeth formed on its outer periphery in addition to the inwardly facing teeth of the annular gear 36. These teeth 65 face outwardly. When the annular ring is in the middle position as shown in FIG. 3C, the out teeth 65 mesh with teeth 67 formed on the inner wall of part 69 of the housing. As such it is prevented from rotation. The inwardly facing set of teeth mesh with the teeth of planet gears 40 only. As the central sun gear 58 rotates due to the shaft 57 rotating, it causes the planet gears 40 to rotate about their shafts 38 as the planet gears are both meshed with the central sun gear 58 and the stationary annular gear 36. As such, the planet gears 40 roll around the inner surface of the annular gear 36. This results in their shafts and the end cap 32 rotating. This in turn causes the spindle 24 and the support cylinder 48 to rotate. The cam cylinder rotates as it is connected to the shaft 57. However, even though the cam cylinder 46 and support cylinder 48 are rotating, the rate of rotation of the support cylinder 48 is different to that the cam cylinder 46 due to the gearing ratio cause by the action of transferring the rotary movement from the central sun gear 58 to the annular gear 36 using the planet gears 40. This results in a relative movement between the two.

The relative movement causes the support cylinder 48 to oscillate as the ball bearing mounted in the support cylinder rolls along the sinusoidal track. As the support cylinder is connected to the ram 42 via the spring 44, the oscillating movement is transferred to the ram 42. The ram 42 comprises a striker 41 which, when a tool bits is held in the chuck 20, strikes the end of the tool bit to cause a hammering action in the normal manner.

As the spindle 24 is rotating, the chuck 20 also rotates. Thus, when the annular gear 36 is located in the position shown in FIG. 3C, the rotary hammer hammers and drills.

In the chisel mode, the annular gear 36 is moved to its most forward position as shown in FIGS. 3D.

When the annular gear 36 in this position, it is prevented from rotation. The second set of outer teeth of the annular gear 36 mesh with teeth 67 formed on the inner wall of part 69 of the housing. As such it is prevented from rotation. The inwardly facing set of teeth mesh with teeth formed on the integral end cap 32 only. As such the spindle 24, is prevented from rotating by the annular gear 36.

As the inner teeth on the annular ring 36 now no longer mesh with the planet gears 40, when the shaft 57 and hence the central sun gear 57 rotates, the planet gears 40, meshed with the central sun gear 58, rotate about their shafts 38. As the planet gears 40 are no longer meshed with the annular gear 36, no force is applied to them to urge them to rotate around the axis of the shaft 57. However, as the spindle24 is prevented from movement due to the integral end cap 32, the shafts 38 of the planet gears 40 are held stationary. As such, the planet gears 40 simply rotate about their shafts 38 only.

As the spindle 24 is stationary, the chuck 20 is held stationary.

As the spindle 24 is stationary, the support cylinder 48 is held stationary. As the shaft 57 rotates, so the cam cylinder 46 rotates. As there is relative movement between the cam cylinder 46 and the support cylinder 48, the support cylinder 48 is caused to oscillate which in turn causes the ram 42 connected to it via the spring to oscillate. If a drill bit is located within the chuck 20, the striker of the ram 42 would hit the end of the drill bit. As such the hammer drill acts in chisel mode only when the annular gear 36 is in the position shown in FIG. 3D.

The shaft 57 and second end cap 59 is driven by the motor 18 via three sets of planet gears 91, and a speed change switch 64 is movable relative to the housing 4 (between positions FIGS. 3A and 3B) to selectively engage or isolate one set of planet gears 91. The use of such gears to reduce the output speed of a hammer is well know and the readers attention is drawn to EPO which provides one example of the use of planet gears.

Figure 4:
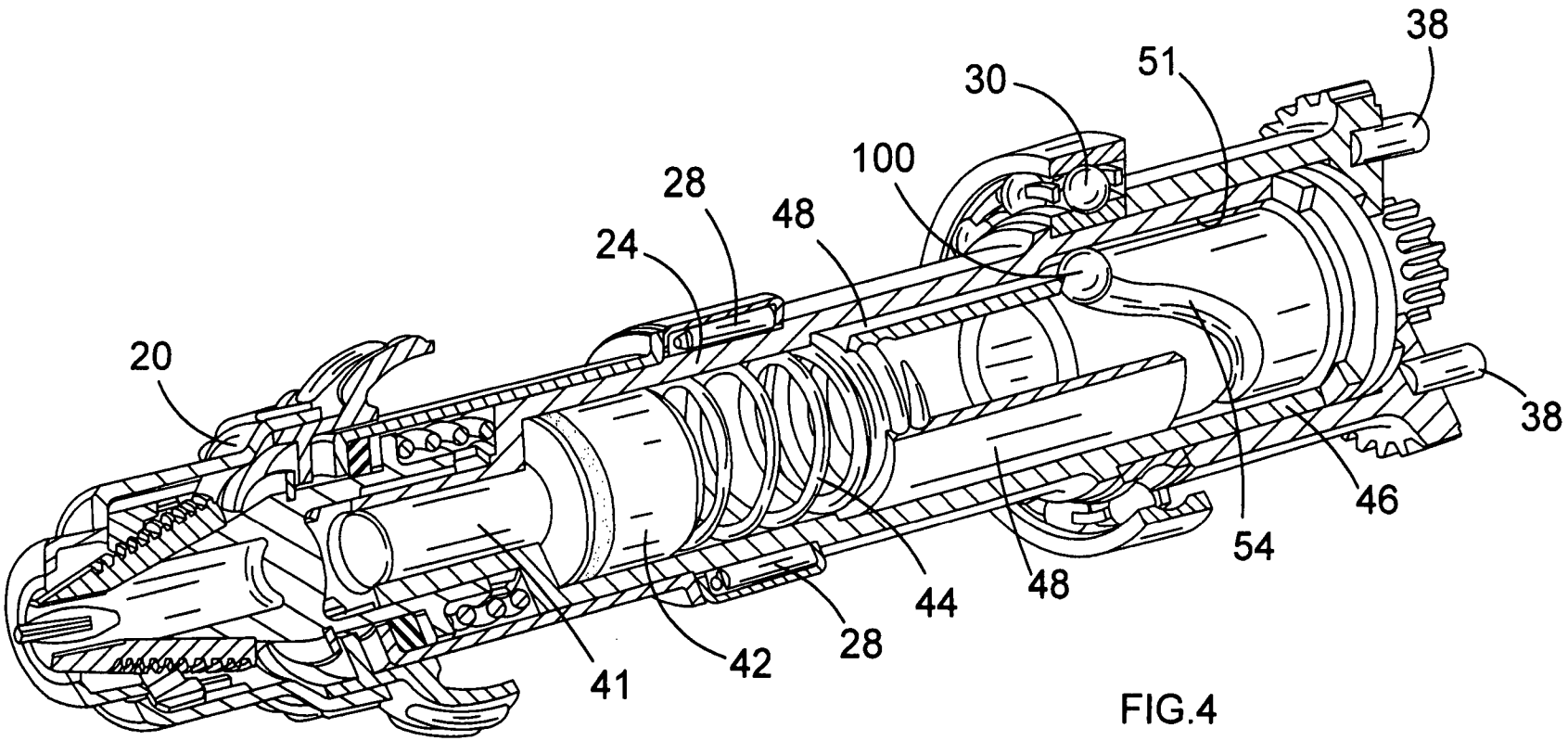
FIG. 4 is a perspective partially cut away view of a rotary hammer of a second embodiment of the present invention.

The second embodiment will now be described with reference to FIG. 4.

The second embodiment is similar in design to the first embodiment. Where the same features have been used in the second embodiment as the first, the same reference numbers have been used.

The difference between the first and second embodiments of the present invention is that the two ball bearings 52,56 in the first embodiment has been replaced by a single ball bearing 100 in the second embodiment. The ball bearing 100 is located within the sinusoidal cam groove 54 of the cam cylinder 46 and the axial groove 51 of the spindle 24 whilst being held within an aperture formed through the wall of the support cylinder 48. The interaction of the ball bearing 100 following the cam groove 54 causes the reciprocating movement of the support cylinder 48. The interaction of the ball bearing 100 following the axial groove 51 causes the rotational movement of the support cylinder 48 with the spindle 24, the axial groove 51 allowing the support cylinder 48 to axially reciprocate relative to the spindle 24. The ball bearing 100 performs the same function as the two ball bearings 52, 56 in the first embodiment. As only one ball bearing 100 is used, the axial groove 50 in the support cylinder of the first embodiment is no longer required and is instead replaced with the aperture in the wall of the support cylinder 48 so that the ball bearing 100 can be located in both the cam groove 54 and the axial groove 51 at the same time whilst its position remains fixed relative to the support cylinder 48.

Figure 5:
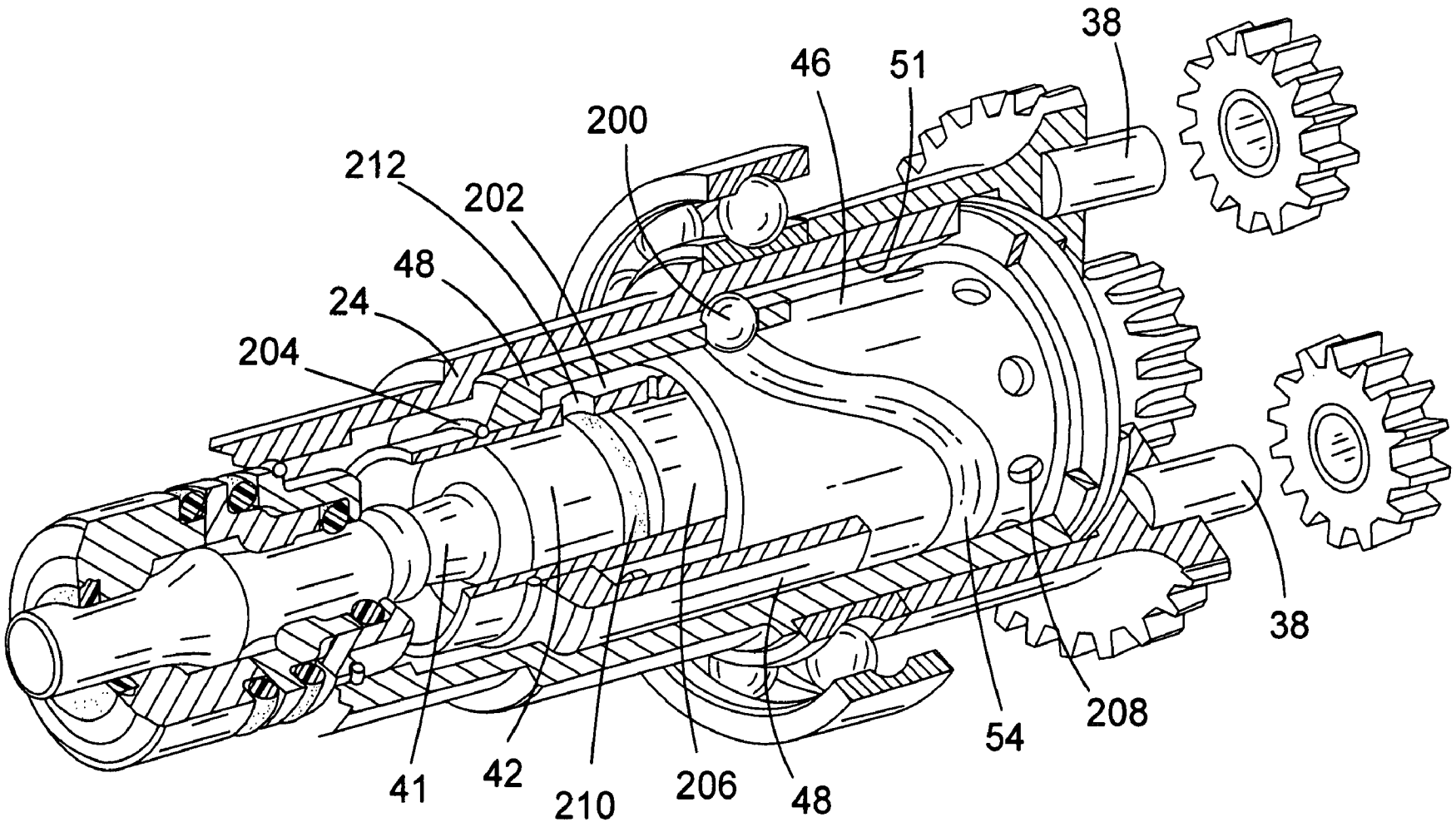
FIG. 5 is a perspective partially cut away view of a rotary hammer of a third embodiment of the present invention.

The third embodiment will now be described with reference to FIG. 5.

The third embodiment is similar in design to the first embodiment. Where the same features have been used in the third embodiment as the first, the same reference numbers have been used.

The first difference between the first and third embodiments of the present invention is that the two ball bearings 52,56 in the first embodiment has been replaced by a single ball bearing 200 in the third embodiment (in the same manner as the second embodiment). The ball bearing 200 is located within the sinusoidal cam groove 54 of the cam cylinder 46 and the axial groove 51 of the spindle 24 whilst being held within an aperture formed through the wall of the support cylinder 48. The interaction of the ball bearing 200 following the cam groove 54 causes the reciprocating movement of the support cylinder 48. The interaction of the ball bearing 200 following the axial groove 51 causes the rotational movement of the support cylinder 48 with the spindle 24, the axial groove 51 allowing the support cylinder 48 to axially reciprocate relative to the spindle 24. The ball bearing 200 performs the same function as the two ball bearings 52, 56 in the first embodiment. As only one ball bearing 200 is used, the axial groove 50 in the support cylinder of the first embodiment is no longer required and is instead replaced with the aperture in the wall of the support cylinder 48 so that the ball bearing 200 can be located in both the cam groove 54 and the axial groove 51 at the same time whilst its position remains fixed relative to the support cylinder 48.

The second difference is that the mechanical spring 44 in the first embodiment has been replaced by an air spring 206.

Located within the support cylinder 48 is a hollow piston 202. The hollow piston 202 is rigidly attached to the support cylinder 48 via a cir clip 204 which prevents relative movement between the two. The cir clip 204 is located towards the front end of the support cylinder 48 where the support cylinder's inner diameter is less than that of the support cylinder 48 at its rear end. The rear end of the support cylinder 48 surrounds the cam cylinder 46 and interacts with the cam cylinder via the ball bearing 200 in a manner described previously. However, the outer diameter of the hollow piston 202 remains constant along its length. The rear end of the hollow piston 202 is located within the cam cylinder 46, the cam cylinder 46 being sandwiched between the rear end of the support cylinder 48 and the rear of the hollow piston 202. The hollow piston can freely slide within the cam cylinder 46.

The ram 42 is located within the hollow piston 202 and comprises a rubber seal 210 which forms an air tight seal between the ram 42 and the inner wall of the hollow piston 202. Air vents 212 are provided in the piston 202.

In use, when the support cylinder 48 is reciprocatingly driven by cam cylinder 46 via ball bearing 200, the hollow piston 202, which is attached to the support cylinder 48 is similarly reciprocatingly driven. The hollow piston 202 in turn reciprocatingly drives the ram 42 via the air spring 206. The operation of the hollow piston 202, air spring 206 and the ram is standard and as such is well known in the art and therefore will be described no further.

Additional vents 208 have been added to the cam cylinder 46 to allow free movement of the air which otherwise would be trapped behind the hollow cylinder 202 within the cam cylinder 46.

The invention claimed is:

1. A power tool comprising:

a housing 4;

a motor 18 mounted within the housing 4;

a tool holder 20 rotatably mounted on the housing 4 for holding a cutting tool;

a striker 42 mounted in a freely slideable manner within the housing, for repetitively striking an end of a cutting tool when a cutting tool is held by the tool holder 42, which striker is reciprocatingly driven by the motor 18, when the motor 18 is activated, a drive mechanism operatively connected between the motor and the striker, the drive mechanism including:

a drive member 46 which is capable of being rotatingly driven by the motor 18;

a driven member 48; and the driven member is connected to the drive member 46 by at least one cam 54 and cam follower 56,100;200, and to the striker 42 via a spring 44;206; and wherein rotation of the drive member 46 relative to the driven member 48 results in a reciprocating motion of the driven member 48 which in turn reciprocatingly drives the striker 42 via the spring 44;206, and in a first mode of operation the motor simultaneously drives in rotation both the drive member and the driven member.

2. A power tool as claimed in claim 1 wherein the first mode of operation the drive member and the driven member turn at the same speed of rotation.

3. A power tool as claimed in claim 1 and further including a second mode of operation wherein the drive member is driven in rotation while the driven member does not rotate.

4. A power tool as claimed in claim 1 wherein the first mode of operation the drive member turns at a first speed of rotation and the driven member turns at a second speed of rotation, and the first speed of rotation is different from the second speed of rotation.

5. A power tool as claimed in claim 1 wherein the cam 54 is sinusoidal.

6. A power tool as claimed claim 1 wherein the cam 54 is in the form of a channel.

7. A power tool as claimed in claim 1 wherein the cam follower 56; 200 is a ball bearing.

8. A power tool as claimed in claim 1 wherein there is provided a spindle 24 in which the striker 42 is slideably mounted, the tool holder 20 being mounted on one end of the spindle 24.

9. A power tool as claimed in claim 1 wherein the spring 44 is mechanical.

10. A power tool as claimed in claim 9 wherein the spring 44 is helical.

11. A power tool as claimed in claim 1 wherein the spring 206 is an air spring.

12. A power tool as claimed claim 1 wherein:

the drive member 46 is a rod having a longitudinal axis, a length, and a uniform circular cross section along the length;

the driven member 48 is a first tubular member of circular cross section which surrounds and is coaxial with the rod 46; and the cam 54 is mounted on the outer surface of the rod and the cam follower 56, 100, 200 is connected to the inner surface of the tube 48.

13. A power tool as claimed in claim 12 wherein there is a second tubular member 24 of circular cross section which surrounds and is coaxial with the first tubular member 48 and which is connected to the first tubular member 48 in such a manner as to prevent any relative rotation between the first tubular member 48 and the second 24 tubular member but which allows a relative axial sliding movement between the first tubular member 48 and the second 24 tubular member.

14. A power tool as claimed in claim 13, wherein second tubular member 24 is connected to the first tubular member 48 using a ball bearing 52,100, 200.

15. A power tool as claimed in claim 14 wherein the ball bearing 100, 200 connecting the second tubular member 24 to the first tubular member 48 also forms the cam follower.

16. A power tool as claimed in claim 13 and wherein the motor 18 is capable of rotatingly driving the second tubular member 24 which in turn rotatingly drives the first tubular member 48.

17. A power tool as claimed in claim 16 wherein the motor 18 is capable of simultaneously driving the rod 46 at a first speed and the second tubular member 24 at a second speed, different from the first speed, to produce a relative rate of rotation between the rod and the second tubular member, which relative rate of rotation results in a reciprocating movement of the first tubular member 48.

18. A power tool as claimed in claim 16 wherein the motor 18 is capable of driving both the first tubular member 48 and the rod 46 at the same speed resulting in no reciprocating movement of the first tubular member 48.

19. A power tool as claimed claim 12 and wherein a part of the spindle forms the second tubular member 24.

20. A power tool as claimed in claim 13 and wherein the drive mechanism comprises a planetary gear system having at least one set of gears comprising a sun gear 58, planet gears 40, an end cap 32 upon which are mounted the planet gears 40, and an axially slideable annular gear 36 wherein the rod 46 is connected to the sun gear 58, the end cap is connected to the second tubular member 48 wherein the annular gear 36 is capable of axially sliding between;

a first position where the annular gear is freely rotatable and both in meshed engagement with the planet gears 40 and rigidly connected to the sun gear 58;

a second position where the annular gear is both in meshed engagement with the planet gears 40 and rigidly connected to the housing to prevent rotation of the annular gear 36.

21. A power tool as claimed in claim 20 and wherein the annular gear 36 is capable of axially sliding to a third position where it is both meshed with the end cap 32 and rigidly connected to the housing to prevent rotation of the annular gear 36.

* * * * *